US006138856A

United States Patent [19]

Ghim et al.

[11] Patent Number: 6,138,856

[45] Date of Patent: Oct. 31, 2000

[54] CONTAINER END CLOSURE

[76] Inventors: Yongjae Ghim; Yongjin Ghim, both of 4515 179th St. SW., Lynnwood, Wash. 98037

[21] Appl. No.: 09/301,756

[22] Filed: Apr. 29, 1999

[51] Int. Cl.[7] ..... B65D 17/34

[52] U.S. Cl. ..... 220/269; 220/270; 220/906; 220/604

[58] Field of Search ..... 220/269, 270, 220/272, 273, 906, 604

[56] References Cited

U.S. PATENT DOCUMENTS

| | | | |
|---|---|---|---|
| 1,319,747 | 10/1919 | Avery | 220/604 |
| 1,441,674 | 1/1923 | Foster et al. | 220/604 |
| 3,221,924 | 12/1965 | Harvey et al. | 220/269 X |
| 3,301,434 | 1/1967 | Harvey et al. | 220/269 X |
| 3,952,911 | 4/1976 | Bozek et al. | 220/269 |
| 3,967,752 | 7/1976 | Cudzik | 220/269 |
| 4,015,744 | 4/1977 | Brown | 220/269 |
| 4,030,631 | 6/1977 | Brown | 220/269 |
| 4,215,794 | 8/1980 | Lewis et al. | 220/270 |
| 4,266,688 | 5/1981 | Reid | 220/273 |
| 4,367,996 | 1/1983 | Saunders | 220/270 X |
| 4,380,303 | 4/1983 | Allen et al. | 220/604 X |
| 4,463,866 | 8/1984 | Mandel | 220/269 |
| 4,605,141 | 8/1986 | Won | 220/269 |
| 5,007,554 | 4/1991 | Hannon et al. | 220/270 X |
| 5,190,149 | 3/1993 | Krause | 220/269 |
| 5,316,166 | 5/1994 | Pavely et al. | 220/269 |
| 5,645,189 | 7/1997 | Clowes | 220/270 X |
| 5,813,561 | 9/1998 | Chang et al. | 220/906 X |
| 5,947,317 | 9/1999 | Hall | 220/269 |

*Primary Examiner*—Stephen K. Cronin
*Assistant Examiner*—Robin A. Hylton

[57] ABSTRACT

A container end closure for facilitating the opening of a pressurized container. The container end closure includes a non-detachable tab having a bulbous end proximate a frangible section of the end closure and a recess in the end closure proximate an opposite end of the tab.

9 Claims, 2 Drawing Sheets

CONTAINER END CLOSURE

BACKGROUND OF THE INVENTION

1. Field of the Invention

The present invention relates to containers with non-detach tab and more particularly pertains to a new container end closure for facilitating the opening of a pressurized container.

2. Description of the Prior Art

The use of container end closures is known in the prior art. More specifically, container end closures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,276,993; U.S. Pat. No. 4,266,688; U.S. Pat. No. 5,749,488; U.S. Pat. No. 4,015,744; U.S. Pat. No. 3,301,434; and U.S. Pat. No. Des. 263,803.

While these devices fulfill their respective, particular objectives and requirements, the aforementioned patents do not disclose a new container end closure. The inventive device includes a non-detachable tab having a bulbous end proximate a frangible section of the end closure and a recess in the end closure proximate an opposite end of the tab.

In these respects, the container end closure according to the present invention substantially departs from the conventional concepts and designs of the prior art, and in so doing provides an apparatus primarily developed for the purpose of facilitating the opening of a pressurized container.

SUMMARY OF THE INVENTION

In view of the foregoing disadvantages inherent in the known types of container end closures now present in the prior art, the present invention provides a new container end closure construction wherein the same can be utilized for facilitating the opening of a pressurized container.

The general purpose of the present invention, which will be described subsequently in greater detail, is to provide a new container end closure apparatus and method which has many of the advantages of the container end closures mentioned heretofore and many novel features that result in a new container end closure which is not anticipated, rendered obvious, suggested, or even implied by any of the prior art container end closures, either alone or in any combination thereof.

To attain this, the present invention generally comprises a non-detachable tab having a bulbous end proximate a frangible section of the end closure and a recess in the end closure proximate an opposite end of the tab.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new container end closure apparatus and method which has many of the advantages of the container end closures mentioned heretofore and many novel features that result in a new container end closure which is not anticipated, rendered obvious, suggested, or even implied by any of the prior art container end closures, either alone or in any combination thereof.

It is another object of the present invention to provide a new container end closure that may be easily and efficiently manufactured and marketed.

It is a further object of the present invention to provide a new container end closure that is of a durable and reliable construction.

An even further object of the present invention is to provide a new container end closure which is susceptible of a low cost of manufacture with regard to both materials and labor, and which accordingly is then susceptible of low prices of sale to the consuming public, thereby making such container end closure economically available to the buying public.

Still yet another object of the present invention is to provide a new container end closure which provides in the apparatuses and methods of the prior art some of the advantages thereof, while simultaneously overcoming some of the disadvantages normally associated therewith.

Still another object of the present invention is to provide a new container end closure for facilitating the opening of a pressurized container.

Yet another object of the present invention is to provide a new container end closure which includes a non-detachable tab having a bulbous end proximate a frangible section of the end closure and a recess in the end closure proximate an opposite end of the tab.

Still yet another object of the present invention is to provide a new container end closure that is easily opened by insertion of a finger into the recessed portion of the end closure.

Even still another object of the present invention is to provide a new container end closure that permits increased leverage by a pivoting tab on a frangible section of the end closure by permitting insertion of a finger beneath one end of the tab.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
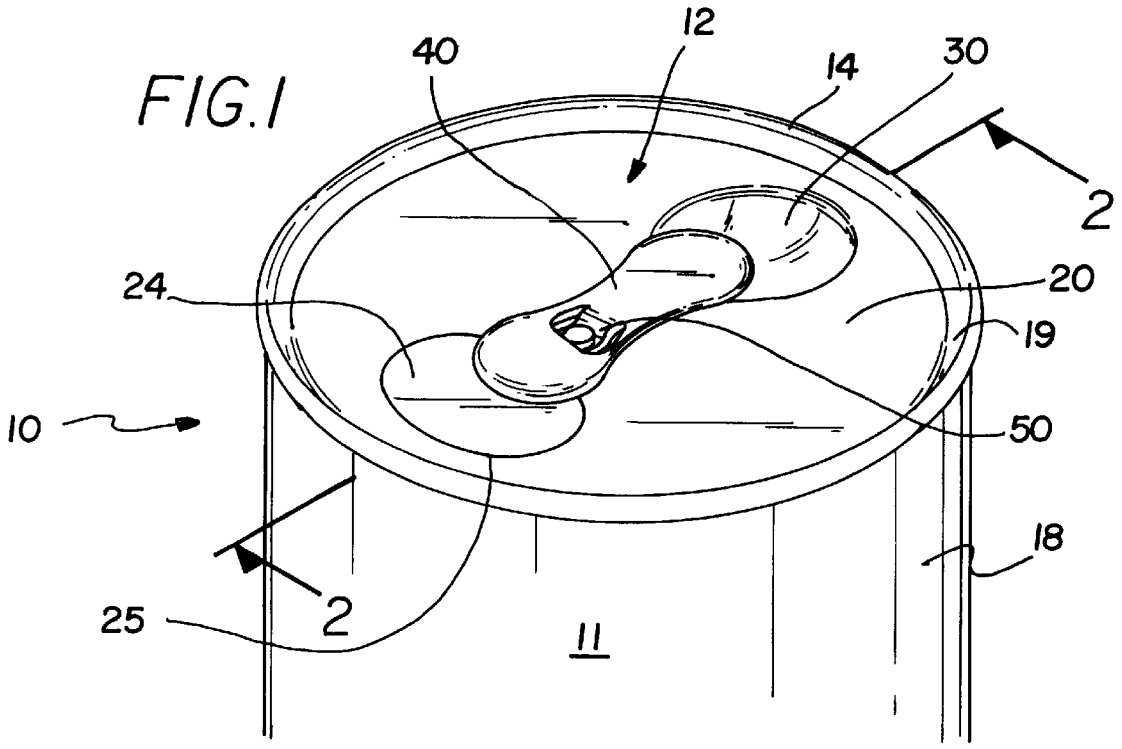
FIG. 1 is a perspective view of a new container end closure according to the present invention.
Figure 2:
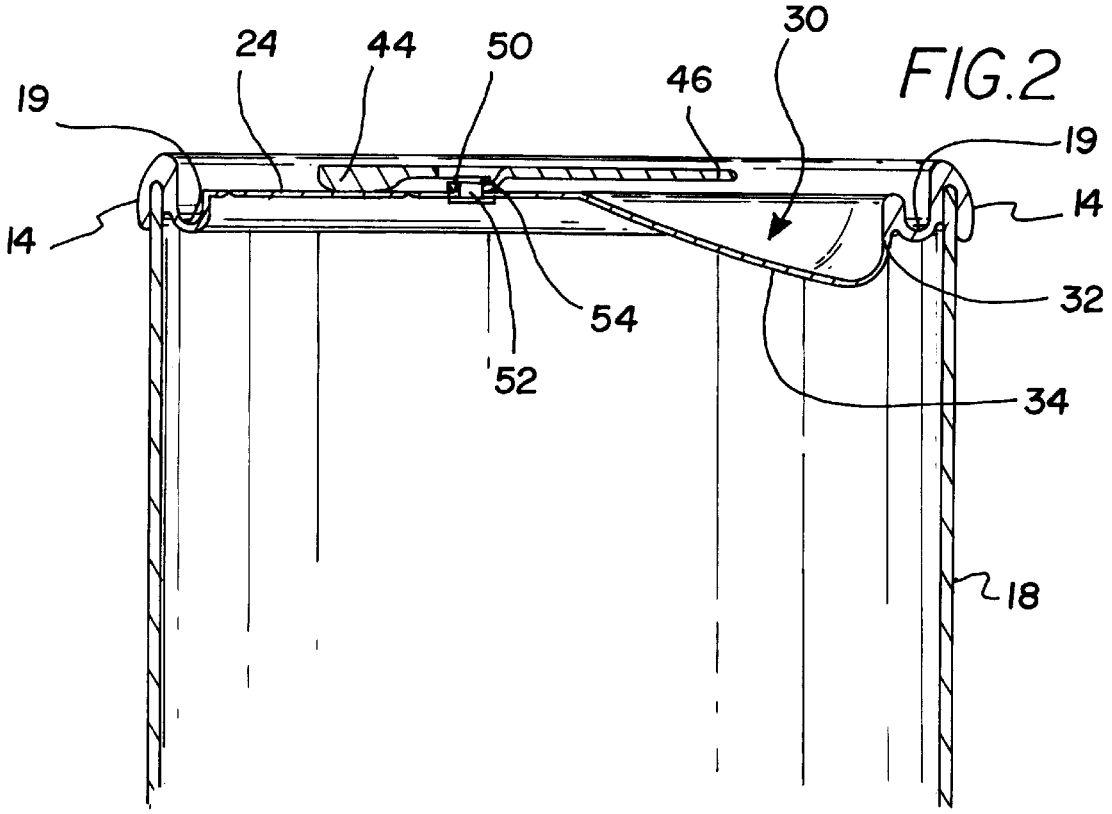
FIG. 2 is a cross-sectional view taken along line 2—2 of FIG. 1.
Figure 3:
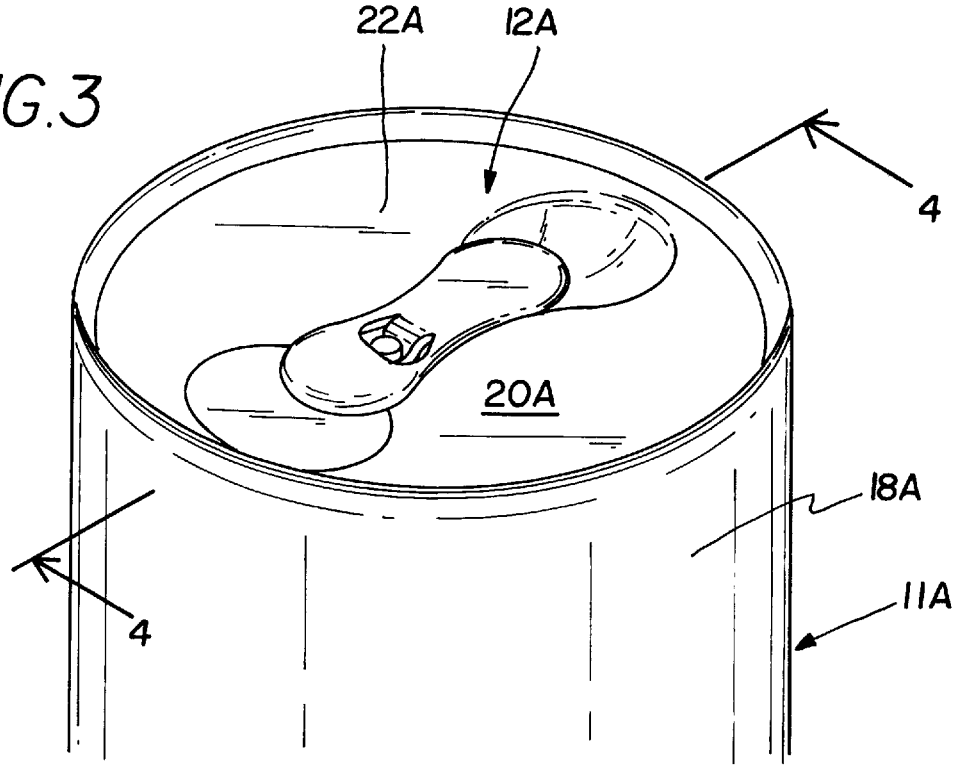
FIG. 3 is a perspective view of an alternate embodiment of the present invention.
Figure 4:
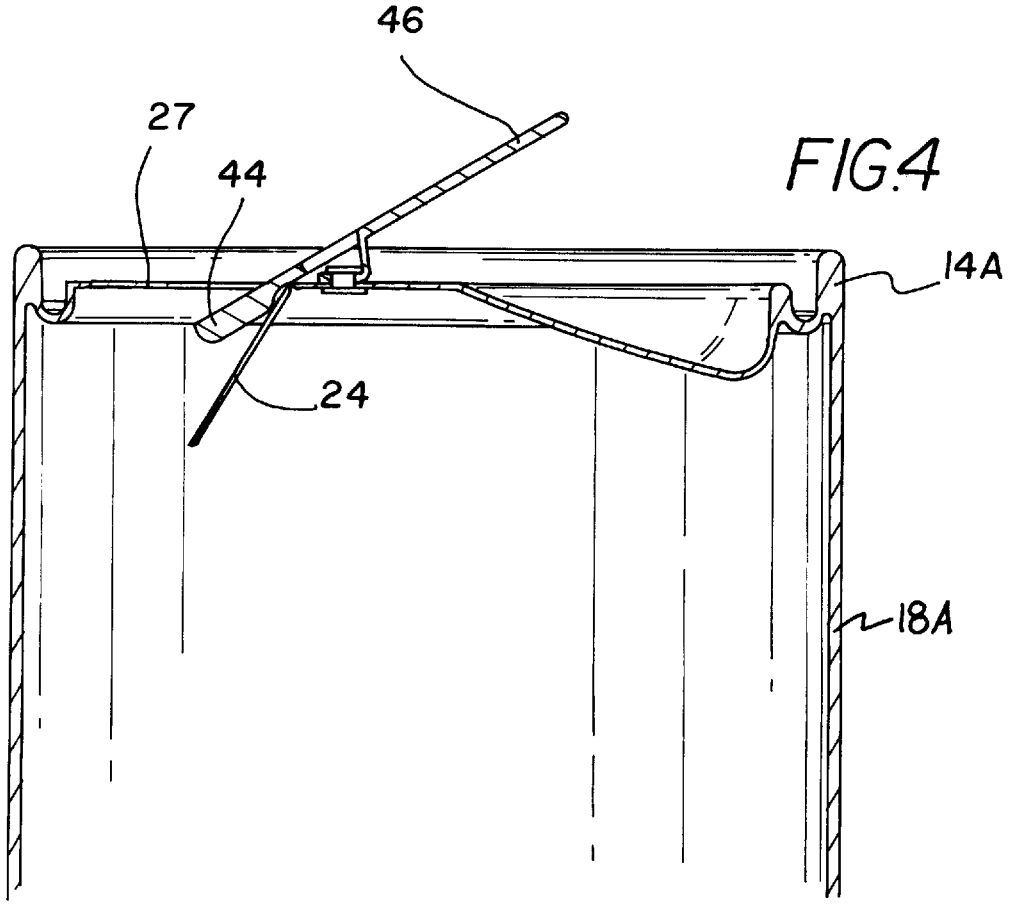
FIG. 4 is a cross-sectional view taken along line 2—2 of FIG. 3.

With reference now to the drawings, and in particular to FIGS. 1 through 4 thereof, a new container end closure embodying the principles and concepts of the present invention and generally designated by the reference numeral 10 will be described.

As best illustrated in FIGS. 1 through 4, the container end closure 10 generally comprises an end wall 12 of sheet material including an outer perimeter 14 and a center portion 20. In a first embodiment, the outer perimeter 14 is designed for engagement to side walls 18 of the can 11.

To facilitate attachment of the end closure 10 to the side walls 18, an inner channel 19 is positioned between the outer perimeter 14 and the center portion 20.

The center portion 20 includes a substantially planar upper surface 22, an opening panel 24 at least partially circumscribed by a scoreline 25, and a generally rounded recess 30 positioned opposite the opening panel 24.

A tab 40 is coupled to the center portion 20 of the end wall 12 at a medial portion 42 of the tab 40. The tab 40 defines a longitudinally rigid lever with a bulbous first end 44 positioned proximate and extending over the opening panel 24 and a second end 46 positioned proximate and extending over the recess 30.

The recess is designed to permit comfortable insertion of a finger into the recess to lift the second end 46 of the tab 40. The bulbous end 44 of the tab 40 is designed for bearing against the opening panel 25 when the second end 46 is lifted. The breakage of the scoreline 25 is initiated by sufficient lifting of the second end 46 whereby the opening panel 24 is urged away from the planar surface 22 to provide an opening 27 in the can 11.

The recess 30 has a substantially vertical portion 32 proximate the inner channel 19 and opposite the opening panel 24. The recess 30 also has a curved bottom portion 34 such that the recess 30 tapers upwardly as it approaches a center of the center portion 20.

The tab 40 is most preferably hour-glass shaped to distribute a substantial portion of a mass of the tab 40 towards the first and second ends 44 and 46 for facilitating opening of the can 11 by breaking the scoreline 25. The bulbous end 44 of the tab 40 also preferably includes a solid construction for increasing a portion of the mass of the tab 40 positioned over the opening panel 24.

The tab 40 has a generally C-shaped slit 48 therein to form a tongue 50 in the medial portion 42 of the tab 40. An open end 49 of the C-shaped slit is oriented to face away from the bulbous end 44 such that the tongue 50 points generally towards the bulbous end 44. A rivet 52 is inserted through the tongue 50 and the center portion 20 of the end wall 12 such that the tongue 50 is coupled to the end wall 12. The rivet 52 includes a flattened upper portion 54 abutting the tongue 50 such that the tongue 50 is prevented from decoupling from the end wall 12 when the second end 46 of the tab 40 is lifted.

In an alternate embodiment, the outer perimeter 14A of the end wall 12A is of solid construction extending substantially orthogonally from the planar upper surface 22A of the center portion 20A to integrally form side walls 18A of the can 11A.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An end closure for a pressurized can, comprising:

an end wall of sheet material having an outer perimeter and a center portion;

wherein said center portion includes a substantially planar upper surface, an opening panel at least partially circumscribed by a scoreline in said center portion, and a generally rounded recess in said center portion, said recess being positioned in diametric opposition to said opening panel;

a tab coupled to said center portion of said end wall, said tab being coupled to said center portion at a medial portion of the tab such that said tab defines a longitudinally rigid lever, said tab having a bulbous first end positioned proximate and extending over said opening panel and a second end positioned proximate and extending over said recess in generally parallel spaced relationship above a face of said end wall; and said recess having a lowermost portion extending below said outer perimeter of said end wall whereby a finger of a user is inserted in said recess for facilitating lifting of said second end of said tab, said bulbous end of said tab bearing against said opening panel when said second end is lifted, wherein breakage of the scoreline is initiated by sufficient lifting of the second end whereby said opening panel is urged away from said planar surface to provide an opening in the can.

2. The end closure of claim 1, further comprising:

an inner channel positioned between said outer perimeter and said center portion.

3. The end closure of claim 2 further comprising:

said recess having a substantially vertical portion proximate said inner channel opposite said opening panel, said recess having a curved bottom portion such that said recess tapers upwardly towards a center of the center portion.

4. The end closure of claim 1, further comprising:

said tab being generally hour-glass shaped whereby a substantial portion of a mass of said tab is distributed generally towards the first and second ends for facilitating opening of the can.

5. The end closure of claim 1, further comprising:

said bulbous end of said tab having a solid construction for increasing a mass of said tab positioned over said opening panel.

6. The end closure of claim 1, further comprising:

said tab having a generally C-shaped slit therein to form a tongue in a medial portion of said tab, an open end of said C-shaped slit facing away from said bulbous end such that said tongue points generally towards said bulbous end, said tongue being coupled to said center portion of said end wall.

7. The end closure of claim 6, further comprising:

a rivet inserted through said tongue and said center portion of said end wall such that said tongue is coupled to said end wall, said rivet having a flattened upper portion abutting said tongue such that said tongue is prevented from decoupling from said end wall when said second end of said tab is lifted.

8. An end closure for a can, comprising:

an end wall of sheet material having an outer perimeter and a center portion, said outer perimeter being adapted for engagement to side walls of the can;

wherein said center portion includes a substantially planar upper surface, an opening panel at least partially circumscribed by a scoreline in said center portion, and a generally rounded recess in said center portion, said recess being positioned in diametric opposition to said opening panel;

a tab coupled to said center portion of said end wall, said tab being coupled to said center portion at a medial portion of the tab such that said tab defines a longitudinally rigid lever, said tab having a bulbous first end positioned proximate and extending over said opening panel and a second end positioned proximate and extending over said recess in generally parallel spaced relationship above a face of said end wall;

said recess having a lowermost portion extending below said outer perimeter of said end wall whereby a finger of a user is inserted in said recess for facilitating lifting of said second end of said tab, said bulbous end of said tab bearing against said opening panel when said second end is lifted, wherein breakage of the scoreline is initiated by sufficient lifting of the second end whereby said opening panel is urged away from said planar surface to provide an opening in the can;

an inner channel positioned between said outer perimeter and said center portion;

said recess having a substantially vertical portion proximate said inner channel opposite said opening panel, said recess having a curved bottom portion such that said recess tapers upwardly towards a center of the center portion;

said tab being generally hour-glass shaped whereby a substantial portion of a mass of said tab is distributed generally towards the first and second ends for facilitating opening of the can;

said bulbous end of said tab having a solid construction for increasing a mass of said tab positioned over said opening panel;

said tab having a generally C-shaped slit therein to form a tongue in a medial portion of said tab, an open end of said C-shaped slit facing away from said bulbous end such that said tongue points generally towards said bulbous end, said tongue being coupled to said center portion of said end wall; and a rivet inserted through said tongue and said center portion of said end wall such that said tongue is coupled to said end wall, said rivet having a flattened upper portion abutting said tongue such that said tongue is prevented from decoupling from said end wall when said second end of said tab is lifted.

9. A can having an end closure, said can comprising:

a can having an end wall of sheet material said end wall having an outer perimeter and a center portion, said center portion having a substantially planar upper surface, said outer perimeter of said end wall being of solid construction extending substantially orthogonally from said planar upper surface of said center portion to form side walls of said can;

an opening panel at least partially circumscribed by a scoreline in said center portion, and a generally rounded recess in said center portion, said recess being positioned in diametric opposition to said opening panel;

a tab coupled to said center portion of said end wall, said tab being coupled to said center portion at a medial portion of the tab such that said tab defines a longitudinally rigid lever, said tab having a bulbous first end positioned proximate and extending over said opening panel and a second end positioned proximate and extending over said recess in generally parallel spaced relationship above a face of said end wall;

said recess having a lowermost portion extending below said outer perimeter of said end wall whereby a finger of a user is inserted in said recess for facilitating lifting of said second end of said tab, said bulbous end of said tab bearing against said opening panel when said second end is lifted, wherein breakage of the scoreline is initiated by sufficient lifting of the second end whereby said opening panel is urged away from said planar surface to provide an opening in the can;

an inner channel positioned between said outer perimeter and said center portion;

said recess having a substantially vertical portion proximate said inner channel opposite said opening panel, said recess having a curved bottom portion such that said recess tapers upwardly towards a center of the center portion;

said tab being generally hour-glass shaped whereby a substantial portion of a mass of said tab is distributed generally towards the first and second ends for facilitating opening of the can;

said bulbous end of said tab having a solid construction for increasing a mass of said tab positioned over said opening panel;

said tab having a generally C-shaped slit therein to form a tongue in a medial portion of said tab, an open end of said C-shaped slit facing away from said bulbous end such that said tongue points generally towards said bulbous end, said tongue being coupled to said center portion of said end wall; and a rivet inserted through said tongue and said center portion of said end wall such that said tongue is coupled to said end wall, said rivet having a flattened upper portion abutting said tongue such that said tongue is prevented from decoupling from said end wall when said second end of said tab is lifted.

* * * * *